United States Patent [19]

Yukimoto et al.

[11] 4,088,847

[45] May 9, 1978

[54] SPEAKER VOICE COIL CONSTRUCTION

[75] Inventors: Sadao Yukimoto, Neyagawa; Tadayoshi Ishihara, Osaka, both of Japan

[73] Assignee: Matsushita Electric Industrial Co., Ltd., Osaka, Japan

[21] Appl. No.: 748,137

[22] Filed: Dec. 6, 1976

[30] Foreign Application Priority Data

| | | |
|---|---|---|
| Apr. 7, 1976 | Japan | 51-39536 |
| Dec. 11, 1975 | Japan | 50-167786[U] |
| Jan. 13, 1976 | Japan | 51-2853[U] |

[51] Int. Cl.[2] ..... H04R 9/04
[52] U.S. Cl. ..... 179/115.5 VC
[58] Field of Search ..... 179/115.5 VC

[56] References Cited

U.S. PATENT DOCUMENTS

| | | | |
|---|---|---|---|
| 1,935,404 | 11/1933 | Leopold | 179/115.5 VC |
| 1,956,826 | 5/1934 | Engholm | 179/115.5 VC |
| 1,991,221 | 2/1935 | Kingsford | 179/115.5 VC |
| 2,007,484 | 7/1935 | Tolerton | 179/115.5 VC |
| 2,039,856 | 5/1936 | Taber | 179/115.5 VC |
| 3,088,001 | 4/1963 | Kleis et al. | 179/115.5 VC |
| 3,991,286 | 11/1976 | Henricksen | 179/115.5 VC |

*Primary Examiner*—George G. Stellar
*Attorney, Agent, or Firm*—Stevens, Davis, Miller & Mosher

[57] ABSTRACT

A speaker comprising a voice coil assembly including a coil formed by pressure-winding an insulation-covered wire on a portion of the outer periphery of a coil bobbin disposed in the gap of a magnetic field, the beginning and the end of the coil being fixed to the coil bobbin by bonding material or adhesive tape, and a diaphragm coupled to the voice coil assembly, whereby the efficiency and performance of the speaker is enhanced.

6 Claims, 14 Drawing Figures

PRIOR ART

SPEAKER VOICE COIL CONSTRUCTION

The present invention relates to a speaker, and more particularly to a speaker having high efficiency and high performance.

The present invention will be apparent from the following detailed description when taken in conjunction with the accompanying drawings, in which.

Figure 1:
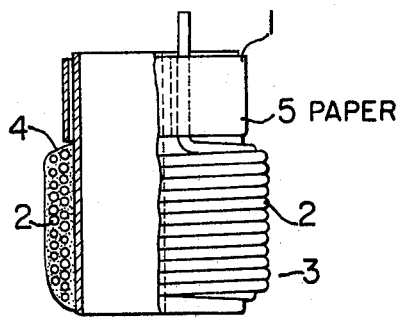
FIG. 1 is a front view, partially in section, of a voice coil used in a prior art speaker.
Figure 2:
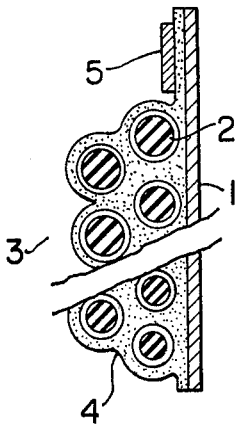
PRIOR ART FIG. 2
FIG. 2 is an enlarged sectional view of a major section of the voice coil assembly of FIG. 1.

Referring now to FIGS. 1 to 5, a voice coil assembly used in a prior art speaker is explained.

An insulation-covered wire 2 is wound on the outer periphery of a coil bobbin 1 to form a coil 3. The windings 2 are fixed by a bonding material 4, and the beginning and the end of the coil 3 are taken out upwardly and fixed by a reinforcing paper 5.

In this construction, since the windings of the coil are coupled together by the bonding material 4 and the coil is coupled to the coil bobbin 1 by the bonding material 4, the mass of the bonding material 4 becomes substantial, which reduced the efficiency of the speaker.

Furthermore, the coil 3 is constructed by fixing the beginning of the wire 2, winding the wire on the coil bobbin 3 from the top to the bottom in an orderly manner to form a first layer, folding the wire at the bottom of the first layer and winding the wire in an orderly manner thereon from the bottom to the top to form a second layer, and taking out the end of the second layer as an end lead.

Each turn of the coil 3 thus constructed is not wound strictly horizontally but it is necessarily wound in a spiral pattern with a slight gradient.

The operation of the voice coil assembly thus constructed, when it is fitted within a magnetic gap 6 of a field of the speaker, is explained with reference to FIG. 3.

Figure 3:
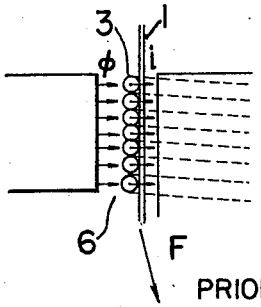
PRIOR ART FIG. 3
FIG. 3 is a view illustrating the operation of the voice coil assembly of FIG. 1.

In FIG. 3, symbol $\phi$ denotes magnetic flux which act horizontally. The symbol $i$ denotes the current flowing through the coil 3. The current $i$ is in the direction perpendicular to the magnetic flux and makes an angle corresponding to the gradient due to the spiral windings. Accordingly, the force F resulting from the action between the magnetic flux $\phi$ and the current $i$ is not in the normal direction but makes an angle which is proportional to the angle of the current $i$.

Accordingly, when an input signal is applied to the coil, it does not move in the direction parallel to a side wall of the magnetic gap 6 but move obliquely thereto. Thus, when a large input signal is applied, the voice coil abuts against the side wall of the magnetic gap 6 such as a center pole or a top plate resulting in the creation of abnormal sound, degradation of the performance and even breakage of coil 3.

Figure 4:
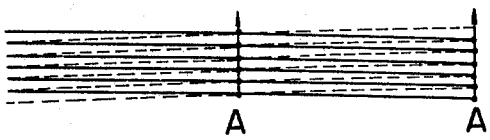
PRIOR ART FIG. 4
FIG. 4 is the developed view illustrating a winding profile of the voice coil assembly of FIG. 1.

Furthermore, since the coil 3 is spirally wound as described above, the first and second layers are wound in opposite directions. The winding pattern of a portion of the first and second layers is shown in FIG. 4 in developed form, in which solid lines show the direction of the windings in the first layer while broken lines show that in the second layer. Even if the windings of the second layer are wound such that each of the windings is disposed at the valleys between the windings of the first layer, each winding of the second layer must ride over the windings of the first layer at two points. In FIG. 4, it has been assumed that the diameter of the insulation-covered wire 2 is uniform everywhere and the gradient of the first layer is exactly the same as the gradient of the second layer. In this case, the ride-over points A for the respective windings are distributed along two axial lines.

However, in actual fact, since the diameter of the insulation-covered wire 2 is not uniform throughout the length and the gradient may differ from layer to layer, the ride-over points A for the second layer are not aligned on the axial line but distributed over almost 360°.

Figure 5:
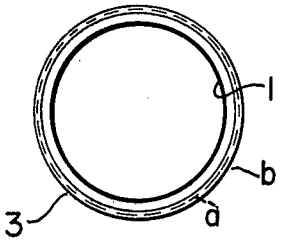
FIG. 5 PRIOR ART
FIG. 5 is a top plan view of the voice coil assembly of FIG. 1.

At the ride-over points A, the outer diameter of the coil is larger than that defined when the wire is disposed at the valleys, as shown in FIG. 5, in which a solid line $a$ shows the outer diameter of the first layer of the coil 3 and a broken line $b$ shows the outer diameter defined when the second layer is wound on the first layer in accordance with the above winding method. The broken line shows the diameter defined when the windings of the second layer are disposed in the valleys of the windings of the first layer.

Accordingly, the outer diameter of the entire coil 3 is the sum of the outer diameter of the coil bobbin 1 and two times the diameter of the wire 2. This does not allow the reduction of the magnetic gap 6 to increase the magnetic flux density for enhancement of the efficiency of the device. Rather it necessitates the use of a magnet having a large magnetic force to form the field or the use of large size field, which are apparently disadvantageous from the view points of cost reduction and size reduction.

It is, therefore, an object of the present invention to provide a speaker which has overcome the disadvantages of the prior art.

It is another object of the present invention to provide a speaker in which the mass of the voice coil is minimum and a correct angular relation between the directions of the magnetic flux and the current is maintained so that the amplitudes at the top and the bottom of the voice coil are equal.

It is another object of the present invention to provide a speaker having a small size field which has a voice coil of generally small diameter and can use a narrow magnetic gap so that the efficiency is enhanced and the creation of abnormal sound due to rubbing in the gap is prevented whereby the degradation of performance as well as breakage of the winding are prevented.

It is still another object of the present invention to provide a speaker which uses windings having alumite layers so that the joule heat of the voice coil is rapidly dissipated whereby the durability is increased and the application of a large input signal is permitted.

It is a further object of the present invention to provide a speaker in which flanges are provided at the top and bottom ends of the coil winding to enhance the coupling between the coil and the coil bobbin whereby drop-off of the coil from the coil bobbin when an input signal of a large amplitude is applied is prevented and hence higher reliability is assured.

It is still another object of the present invention to provide a speaker which posseses a number of advantages described above and hence has a high industrial value.

The preferred embodiments of the present invention are now described with reference to FIGS. 6 to 11.

Figure 6:
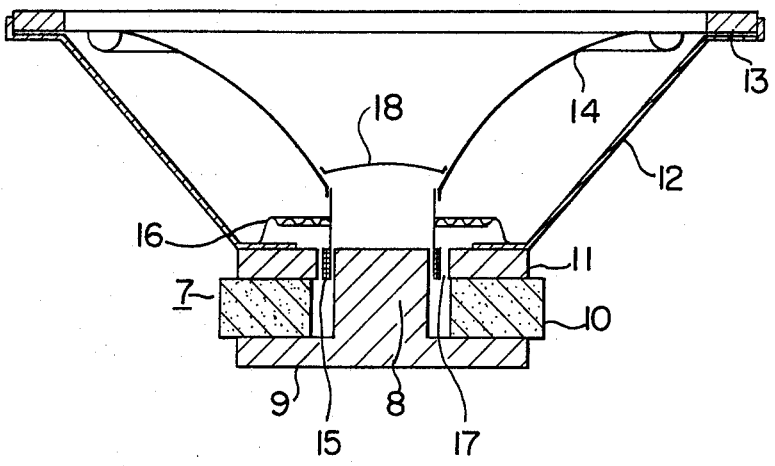
FIG. 6 is a sectional view showing one embodiment of a speaker in accordance with the present invention.

Referring first to FIG. 6, there is shown the overall construction of a speaker in accordance with one embodiment of the invention. Numeral 7 denotes a field which includes a plate 9 having a center pole 8 at the center of the top surface thereof, a ring-shaped magnet 10 and a ring-shaped top plate 11. The field of this construction is referred to as an externally excited field. Alternatively, a field of the internally excited type which incorporates a post-shaped magnet or a laminated assembly of a post-shaped magnet and a pole piece may be used.

A frame 12 is coupled to the field 7 by welding or the like. A gasket 13 and the peripheral edge of a diaphragm 14 are attached to the periphery of the frame 12 by bonding or the like.

At the center of the diaphragm 14, there is mounted a voice coil 15 with an intermediate portion thereof being supported by a damper 16 so that the voice coil 15 is fitted in a magnetic gap 17 of the field 7 without eccentricity. Attached at the center of the top surface of the diaphragm 14 is a dust cap 18 for preventing the dust in the air from entering the magnetic gap 17.

Figure 7:
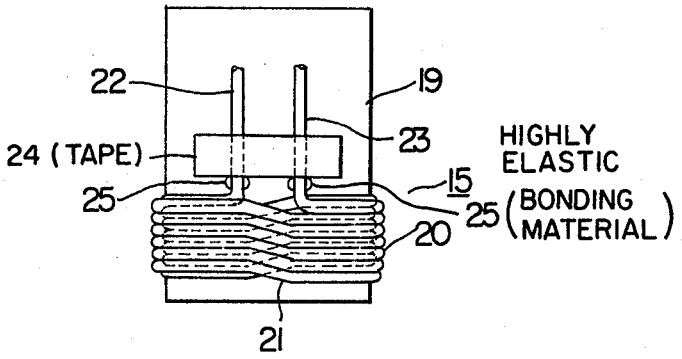
FIG. 7 is a front view of the voice coil assembly used in the speaker of FIG. 6.

The construction of the voice coil 15 is shown in detail in FIG. 7. As seen from FIG. 7, the voice coil 15 is formed by a cylindrical coil bobbin 19 made of kraft paper or a metal foil such as aluminum foil and a coil 20 formed by winding an insulation-covered wire on a lower portion of the outer periphery of the coil bobbin 19.

Unlike the spiral winding of the prior art, the coil 20 is wound in what is called the horizontal winding method in which a major portion of one turn of the windings, e.g. over 340° to 350°, extends horizontally and a remaining portion, e.g. over 10° to 20°, extends obliquely to shift to the adjacent turn to form a continuous winding. Both the first layer and the second layer are wound by the horizontal winding method. The second layer starts from the bottom end of the first layer by folding the wire thereat, and the windings of the second layer are disposed exactly in the valleys of the windings of the first layer. At the transition region 21, the windings of the second layer ride-over the obliquely extending winding portions of the first layer. Thus, the ride-over points of the second layer substantially align along a single line. Beginning 22 of the first layer and end 23 of the second layer extend upwardly and are fixed by a tape 24 for use as lead wires.

The coil 20 is pressure-wound and the beginning 22 and the end 23 are attached to the coil bobbin 19 by fixing them by highly elastic bonding material 25 and the tape 24. The pressure-winding method is carried out by winding the wire under tension. In this case, the coil 20 is strongly coupled to the coil bobbin 19 by a tightening force exerted on the coil bobbin 19 by the coil 20 and an expanding force exerted on the coil 20 by the coil bobbin 19 as a result of counteraction to the tightening force. Accordingly, the force created in the coil 20 is transmitted to the coil bobbin 19 through the frictional coupling therebetween to precisely vibrate the diaphragm 14.

Since the allowable input magnitude is determined by the coupling force between the coil 20 and the coil bobbin 19, the selection of the materials of the wire and the coil bobbin 19 is important. Because the voice coil 15 normally generates joule heat when an input signal is applied across the coil and hence its temperature rises above a surrounding temperature, it is desirable to use a coil bobbin material having a higher thermal expansion coefficient than that of the wire material in order to assure a high frictional force at a high temperature. For this reason, it is most preferable to use copper for the wire and aluminum for the coil bobbin 19.

With the above construction, the amount of the bonding material 25 required can be considerably reduced compared with the prior art construction, and hence the mass of the voice coil 15 can be considerably reduced resulting in enhancement of the efficiency of the speaker.

Figure 8:
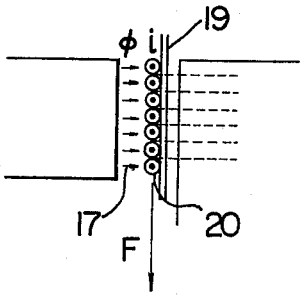
FIG. 8 is a view illustrating the operation of the voice coil assembly of FIG. 7.

The operation of the above construction where the voice coil 15 is fitted in the magnetic gap 17 as shown in FIG. 8 is now considered. Because of the horizontal winding, the current $i$ flowing through the coil 20 is exactly normal to the magnetic flux $\phi$ and hence the force F created in accordance with Fleming's left hand law is in the perpendicular direction, that is, in the direction parallel to the side wall of the magnetic gap 17. Therefore, an exact piston movement is assured.

Figure 9:
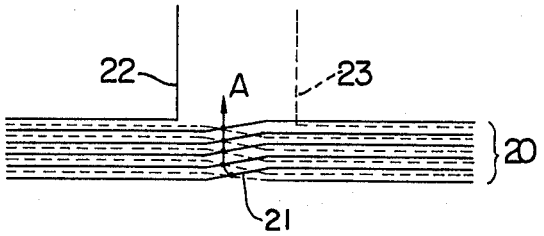
FIG. 9 is a developed view illustrating the winding profile of the voice coil assembly of FIG. 7.
Figure 10:
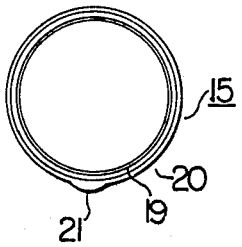
FIG. 10 is a top plan view of the voice coil assembly of FIG. 7.

FIG. 9 shows a development of the coil 20 wound in the manner described above. As seen from FIG. 9, the ride-over points A of the second layer over the transition region 21 of the first layer substantially align along a single line. A top plan view of the coil 20 is shown in FIG. 10. It is seen from FIG. 10 that since a substantial portion of the second layer is disposed within the valleys of the first layer, the diameter of the coil 20 is the sum of the outer diameter of the coil bobbin 19 and the diameter of the wire for the first layer and about one half of the diameter of the wire for the second layer, except at the transition region 21 where the coil diameter is the sum of the coil bobbin 19 and double of the diameter of the wire. Accordingly, the voice coil can be considerably reduced in size and the use of a narrow magnetic gap 17 is permitted so that the magnetic flux density can be increased to enhance the efficiency of the speaker.

Figure 11:
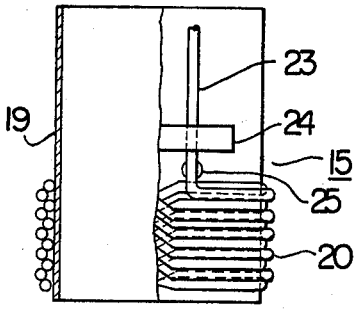
FIG. 11 is a front view, partially in section, of a voice coil assembly in accordance with other embodiment of the present invention.

The diameter of the voice coil 15 can be further reduced by pitch-winding the coil as shown in FIG. 11, instead of close-winding as described above, such that the windings of the second layer are more deeply fitted in the valleys of the windings of the first layer.

As described above, the voice coil 15 generates joule heat when an input signal is applied across the coil. Thus, when the coil bobbin 19 is formed by the kraft paper, it may be carbonized by the joule heat. The tape 24 and the highly elastic bonding material 25 which serve to fix the beginning 22 and the end 23 of the coil 20 may also be deteriorated. When this occurs the beginning 22 and the end 23 will become loose. To prevent such inconvenience, it is desirable to form the coil bobbin 19 by impact molding a metal foil such as an aluminum foil into a cylindrical structure and to use a material having a high heat dissipation property as the wire of the coil 20.

Figure 12:
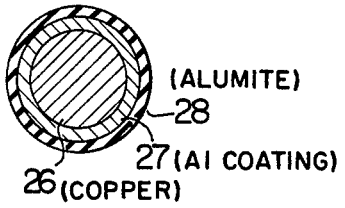
FIG. 12 is a sectional view of wires forming a voice coil assembly in accordance with a further embodiment of the present invention.

As an example of the wire of the coil 20, referring to FIG. 12, an aluminum coating 27 is formed on the surface of a wire 26 such as copper and an alumite layer 28 which serves as an insulative layer is further formed on the surface of the aluminum coating 27 by the alumite process. By dipping the beginning 22 and the end 23 of the wire in a caustic soda solution, the alumite layer 28 and the aluminum coating 27 can be readily removed so that soldering to the wire 26 such as copper can be easily and reliably carried out.

Figure 13:
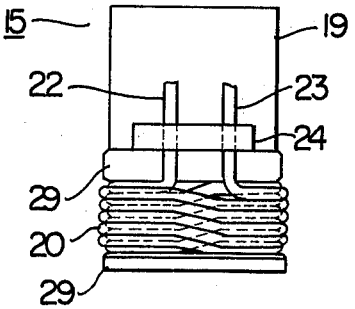
FIG. 13 is a front view showing a voice coil assembly in accordance with still another embodiment of the present invention.
Figure 14:
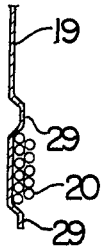
FIG. 14 is a sectional view of the voice coil assembly of FIG. 13.

As shown in FIGS. 13 and 14, flanges 29 may be provided at the top and bottom end of the winding of the coil 20 on the coil bobbin 19 to further enhance the coupling between the pressure-wound and orderly coil 20 and the coil bobbin 19. With this construction, even when a large input signal is applied to the coil 20 to over-vibrate the voice coil assembly 15, the drop-off of the coil 20 from the coil bobbin 19 is prevented.

What is claimed is:

1. A speaker comprising means for generating a magnetic field, said means having a gap therein, a voice coil assembly located within said gap, said voice coil assembly including a bobbin having a longitudinal axis, a first layer of insulation-covered wire pressure-wound on a portion of the outer periphery of said bobbin, a second layer of insulation-covered wire pressure-wound on said first layer of wire, said second layer of wire being located on and between adjacent turns of said first layer of wire, a major portion of each turn of said first and second layers of wire extending in a plane perpendicular to said longitudinal axis and the remaining portion thereof extending in a direction which is oblique to said plane, and means for bonding the ends of said wire to said bobbin, and a diaphragm coupled to said voice coil assembly.

2. A speaker according to claim 1 wherein said coil bobbin is made of a metal foil, and said wire of said coil is made of a conductor on which an aluminum coating and alumite layer are formed.

3. A speaker according to claim 1 wherein said coil bobbin is made of aluminum and said wire is made of copper.

4. A speaker according to claim 1 wherein flanges are provided at the top and bottom ends of the winding of the coil on the coil bobbin to support the top and bottom ends of the coil.

5. A speaker comprising means for generating a magnetic field, said means having a gap therein, a voice coil assembly located within said gap, said voice coil assembly including a bobbin having a longitudinal axis, a first layer of insulation-covered wire pressure-wound on a portion of the outer periphery of said bobbin, a major portion of each turn of said first layer extending in a plane perpendicular to said longitudinal axis and the remaining portion thereof extending in a first direction which is oblique to said plane.

a second layer of insulation-covered wire pressure-wound on and between adjacent turns of said first layer, a major portion of each turn of said second layer extending in a plane perpendicular to said longitudinal axis and the remaining portion thereof forming a transition region extending in a second direction which is oblique to said plane and to said first direction, the points at which each turn of said second layer crosses over a corresponding turn of said first layer in said transition region defining a line substantially parallel to said longitudinal axis, and means for bonding the ends of said wire to said bobbin, and a diaphragm coupled to said voice coil assembly.

6. A speaker according to claim 5 wherein the diameter of said voice coil assembly outside said transition region is approximately the sum of the outer diameter of said bobbin, the diameter of the wire of said first layer and one-half the diameter of the wire of said second layer, the diameter of said voice coil assembly within said transition region being approximately the sum of the outer diameter of said bobbin, the diameter of the wire of said first layer, and the diameter of the wire of said second layer.

* * * * *